US005095972A

United States Patent [19]

Nakaguro

[11] Patent Number: 5,095,972

[45] Date of Patent: * Mar. 17, 1992

[54] HEAT EXCHANGER

[75] Inventor: Kazuhiro Nakaguro, Isesaki, Japan

[73] Assignee: Sanden Corporation, Gunma, Japan

[ * ] Notice: The portion of the term of this patent subsequent to Dec. 18, 2007 has been disclaimed.

[21] Appl. No.: 515,047

[22] Filed: Apr. 26, 1990

[30] Foreign Application Priority Data

Apr. 27, 1989 [JP] Japan ..... 1-48841[U]

[51] Int. Cl.[5] ..... F28D 1/053

[52] U.S. Cl. ..... 165/153; 165/175; 165/176

[58] Field of Search ..... 165/150, 152, 153, 175, 165/176

[56] References Cited

U.S. PATENT DOCUMENTS

| | | | |
|---|---|---|---|
| 230,815 | 8/1880 | Puffer | 165/176 |
| 1,834,070 | 12/1931 | Parkinson | 165/97 |
| 2,867,416 | 1/1959 | Lieberherr | 165/176 |
| 4,589,265 | 5/1986 | Nozawa | 165/152 |
| 4,771,942 | 9/1988 | Arold et al. | 165/176 |
| 4,825,941 | 5/1989 | Hoshino et al. | 165/176 |
| 4,901,792 | 2/1990 | Komiya | 165/175 |
| 4,977,956 | 12/1990 | Aoki et al. | 165/153 |

FOREIGN PATENT DOCUMENTS

| | | | |
|---|---|---|---|
| 63427 | 9/1955 | France | 165/176 |
| 116817 | 7/1946 | Sweden | 165/176 |
| 16730 | of 1904 | United Kingdom | 165/150 |
| 2078361A | 6/1981 | United Kingdom . | |

*Primary Examiner*—John Rivell
*Assistant Examiner*—L. R. Leo
*Attorney, Agent, or Firm*—Banner, Birch, McKie & Beckett

[57] ABSTRACT

A heat exchanger includes a pair of header pipes, a plurality of heat-transfer tubes parallel to each other, a block provided at a position on a single or two or more heat transfer tubes between the header pipes and having at least one of an inlet port and an outlet port for a heat exchange medium. The block is freely located at a desired medial position between the header pipes as required. Since the inlet port or outlet port is located at an optimum position between the header pipes, connection of a pipe or tube thereto can be easily accomplished.

15 Claims, 6 Drawing Sheets

HEAT EXCHANGER

BACKGROUND OF THE INVENTION

1. Field of the Invention

The present invention relates to a heat exchanger, and more specifically to a heat exchanger which is to be installed in a small limited space such as a condenser used in an air conditioner for vehicles.

2. Description of the Prior Art

A conventional heat exchanger for use as a condenser in an automobile is constructed, for example, as shown in FIGS. 12 and 13. The heat exchanger has a pair of header pipes 1 and 2 extending in parallel relation with each other, and a plurality of flat heat-transfer tubes 3 disposed between the header pipes in parallel relation with one another and connected to the header pipes at their end portions. A plurality of radiation fins 4 are provided between flat heat-transfer tubes 3 to accelerate the radiation from the flat heat-transfer tubes. An inlet tube 5 is connected to header pipe 1 for introducing a cooling medium into the heat exchanger and an outlet tube 6 is connected to header pipe 2 for delivering the condensed cooling medium from the heat exchanger to other equipment.

The insides of header pipes 1 and 2 are divided into a plurality of spaces in their axial directions by partitions 7 and 8, respectively. The cooling medium introduced through inlet tube 5 flows in a serpentine passage shown by arrows through header pipes 1 and 2 and flat heat-transfer tubes 3 until the heat exchanged and condensed cooling medium flows out from outlet tube 6.

In such a conventional heat exchanger, allowable positions for inlet tube 5 and outlet tube 6 are generally restricted within respective small and limited areas. When the positions of inlet tube 5 and outlet tube 6 are restricted, it is often very difficult to connect pipes or tubes to the inlet and outlet tubes for introducing the cooling medium into the inlet tube and delivering the cooling medium out from the outlet tube. For instance, in a case where the heat exchanger is installed in an engine room of an automobile, pipes or tubes to be connected to inlet tube 5 and outlet tube 6 must often be drawn around the heat exchanger in a small space, because the space for locating the pipes or tubes is generally quite limited in the engine room. The installation of the pipes and tubes, therefore, is often very difficult. According to circumstances, a pipe or tube cannot generally be connected directly to the inlet tube or outlet tube of the heat exchanger. In such a case, for example, as shown in FIG. 13, inlet tube 9 (or an outlet tube) must be designed to extend to a position where a pipe or tube can be connected to the extended inlet tube 9 (or extended outlet tube).

SUMMARY OF THE INVENTION

Accordingly, an object of the present invention is to provide a heat exchanger having a greatly expanded versatility in the positioning of its inlet port and outlet port for a heat exchange medium; and thereby make it easy to connect a pipe or tube to the inlet port and/or the outlet port.

To achieve this object, a heat exchanger according to the present invention comprises a pair of substantially parallel header pipes; a plurality of substantially parallel heat-transfer tubes disposed between the header pipes, each heat-transfer tube being connected to each of the header pipes; and a block provided at a position between the header pipes and connected to at least one of the heat-transfer tubes. The block has at least one chamber therein communicating with at least one heat-transfer tube and at least one of an inlet port and an outlet port for a heat medium thereon communicating with the at least one chamber in the block.

In the heat exchanger, the block having an inlet port and/or an outlet port can be located substantially at any position between the header pipes as long as the block is connected to at least one of the heat-transfer tubes. Therefore, the inlet port and/or the outlet port for the heat medium can be located at a free position along at least one heat-transfer tube between the header pipes, and a pipe or a tube can be easily connected to the inlet port or/and the outlet port without drawing the pipe or the tube around the heat exchanger. As a result, the installation and connection of the pipes or tubes to the ports can be easily conducted, even if the space provided for installation of the heat exchanger is a small and limited space.

BRIEF DESCRIPTION OF THE DRAWINGS

Some preferred exemplary embodiments of the invention will now be described with reference to the accompanying drawings which are given by way of example only, and thus are not intended to limit the present invention.

DETAILED DESCRIPTION OF PREFERRED EMBODIMENTS OF THE INVENTION

Figure 1:
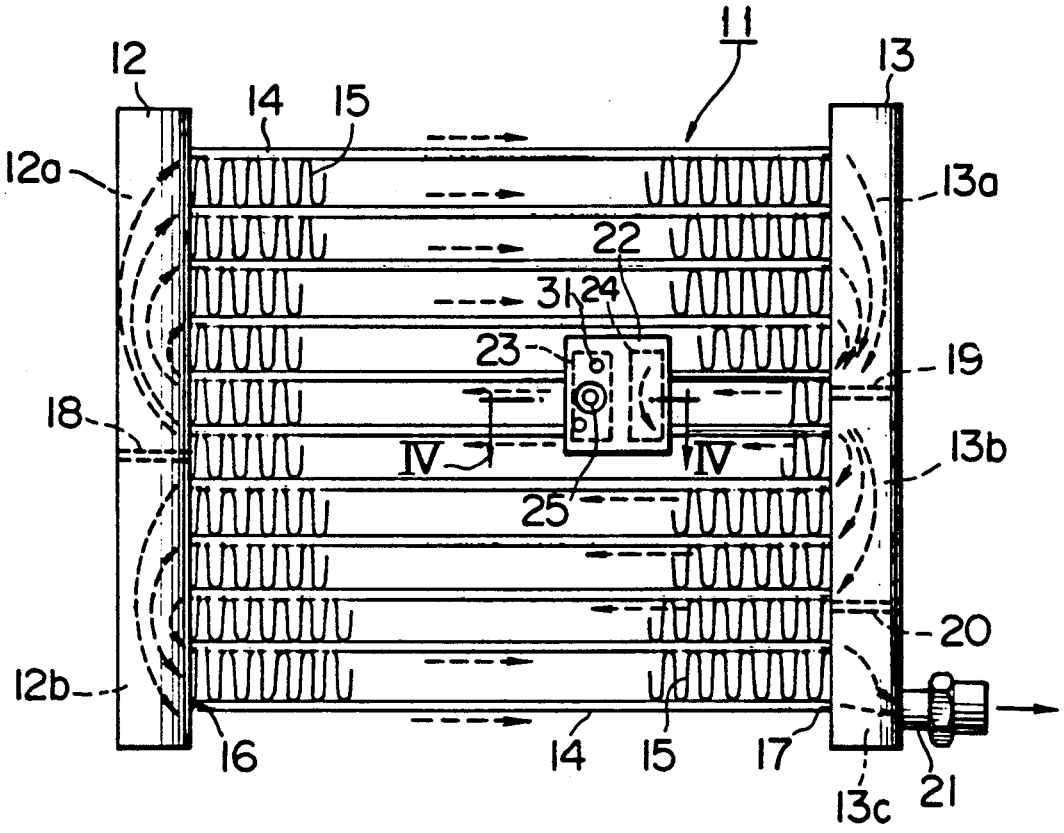
FIG. 1 is an elevational view of a heat exchanger according to a first embodiment of the present invention.
Figure 2:
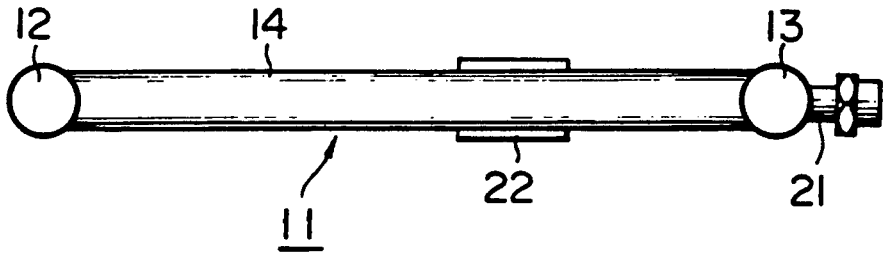
FIG. 2 is a plan view of the heat exchanger shown in FIG. 1.

Referring to the drawings, FIGS. 1-5 illustrate a heat exchanger according to a first embodiment of the present invention. A heat exchanger 11 has a pair of substantially parallel header pipes 12 and 13, a plurality of substantially parallel heat-transfer tubes 14 disposed between the header pipes, and a plurality of radiation fins 15 disposed on the sides of the heat-transfer tubes. Although heat-transfer tubes 14 are formed as flat tubes in this embodiment, they may be formed as other type tubes. Radiation fins 15 are formed as corrugate type fins. Header pipes 12 and 13 have a plurality of holes 16 and 17 on the respective surfaces facing each other. The end portions of each heat-transfer tube 14 are inserted into holes 16 and 17, respectively, so that the heat-transfer tube is connected to header pipes 12 and 13 at its end portions and communicates with the inside spaces of the header pipes.

A partition 18 is provided in header pipe 12 at a position between the sixth heat-transfer tube 14 and the seventh heat-transfer tube 14 counted from the upper side. Of course the specific number of heat-transfer tubes is not critical to the invention. Partition 18 divides the inside space of header pipe 12 into spaces 12*a* and 12*b*. The inside space of header pipe 13 is divided into spaces 13*a*, 13*b* and 13*c* by partitions 19 and 20. Partition 19 is provided at a position between the fifth and the sixth heat-transfer tubes 14, and partition 20 is provided at a position between the ninth and the tenth heat-transfer tubes. An outlet tube 21 is connected to header pipe 13 at its lower portion as an outlet for a cooling medium. Outlet tube 21 communicates with inside space 13*c* of header pipe 13.

A block 22 is provided on a middle portion of the fifth and the sixth heat-transfer tubes 14 such that the block is connected to both of the heat-transfer tubes. Block 22 has two chambers 23 and 24 therein separated from each other. Chamber 23 communicates with the left portions of the fifth and the sixth heat-transfer tubes 14, and chamber 24 communicates with the right portions of the heat-transfer tubes. An inlet port 25 is provided on block 22 as an inlet for the cooling medium. Inlet port 25 communicates with chamber 23.

Figure 3:
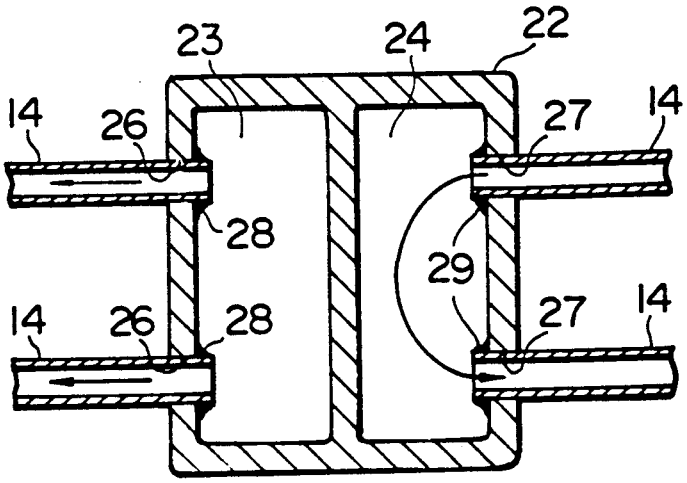
FIG. 3 is an enlarged vertical sectional view of a block portion of the heat exchanger shown in FIG. 1.
Figure 4:
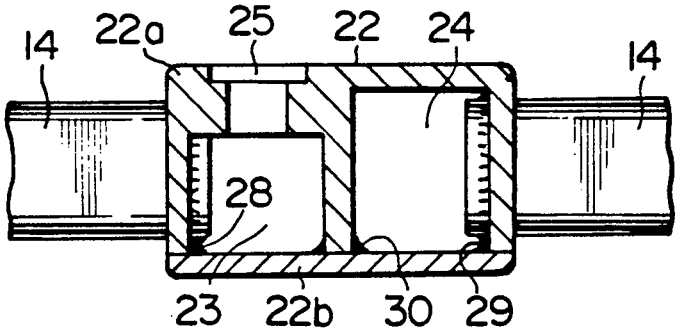
FIG. 4 is an enlarged cross-sectional view of the block portion of the heat exchanger shown in FIG. 1 taken along IV—IV line of FIG. 1.
Figure 5:
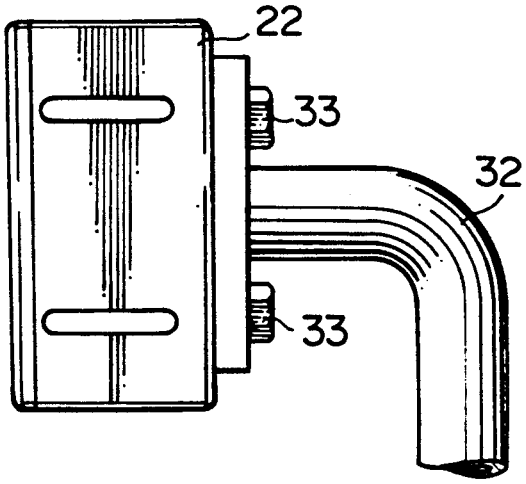
FIG. 5 is an enlarged side view of a block of the heat exchanger shown in FIG. 1 and a connection pipe for the heat exchanger.

The left and right end portions of the fifth and the sixth heat-transfer tubes 14 are inserted into holes 26 and 27 defined on the side walls of block 22, so as to slightly project into chambers 23 and 24, and fixed to the block at portions 28 and 29 by brazing as shown in FIGS. 3 and 4. Block 22 is constructed of block body 22*a* and cover plate 22*b*. The cover plate is fixed to the block body at portions 30 by brazing. In FIGS. 3 and 4, radiation fins 15 are omitted. Boltholes 31 (FIG. 1) are defined on block 22 around inlet port 25. Connection pipe 32 is connected to block 22 via bolts 33 screwed into boltholes 31, for introducing the cooling medium from other equipment into the block of heat exchanger 11, for example, as shown in FIG. 5.

In this embodiment, the cooling medium flows in heat exchanger 11 as shown by arrows in FIG. 1. The cooling medium introduced by connection pipe 32 flows into chamber 23 of block 22 through inlet port 25. Thereafter the cooling medium flows into the left portions of the fifth and the sixth heat-transfer tubes 14, and then into inside space 12*a* of header pipe 12. The cooling medium flows upward in inside space 12*a* and into the first to the fourth heat-transfer tubes 14. The cooling medium flows into inside space 13*a* of header pipe 13 through the first to the fourth heat-transfer tubes 14, and then into the right portion of the fifth heat-transfer tube 14. The cooling medium flows into chamber 24 of block 22 through the right portion of the fifth heat-transfer tube 14, turns in the chamber 24, and then flows into the right portion of the sixth heat-transfer tube 14. The cooling medium flows into inside space 13*b* of header pipe 13 from the right portion of the sixth heat-transfer tube 14, flows downward in the inside space, and then flows into the seventh to the ninth heat-transfer tubes. The cooling medium flows into inside space 12*b* of header pipe 12 through the seventh to the ninth heat-transfer tubes 14, flows downward in the inside space 12*b*, and then flows into the tenth and the eleventh heat-transfer tubes. The cooling medium flows into inside space 13*c* of header pipe 13 through the tenth and the eleventh heat-transfer tubes 14, and flows out from the inside space through outlet tube 21. During this passage, the cooling medium is gradually condensed by radiation. Radiation fins 15 accelerate the radiation from the heat-transfer tubes 14.

In the heat exchanger, since block 22 is positioned on a medial portion of heat-transfer tubes 14 between header pipes 12 and 13, and inlet port 25 for the cooling medium is provided on the block, the inlet port can be disposed at a desirable medial position between the header pipes. In other words, inlet port 25 can be disposed at almost any position between header pipes 12 and 13 by connecting block 22, having the inlet port and chambers 23 and 24, freely to selected heat-transfer tubes 14. Therefore, the design freedom in positioning the inlet port 25 is greatly increased, which in turn facilitates easy connection of connection pipe 32 to the inlet port even if the space around heat exchanger 11 is small and limited.

Figure 6:
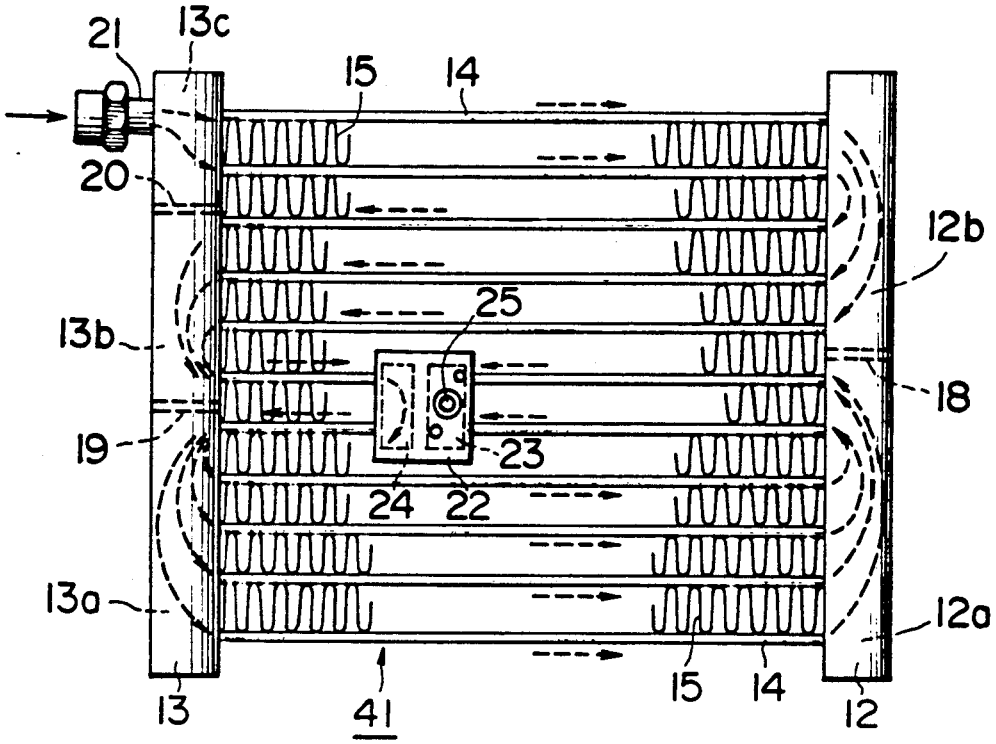
FIG. 6 is an elevational view of a heat exchanger according to a modification of the heat exchanger shown in FIG. 1.

FIG. 6 illustrates a modification of the heat exchanger shown in FIG. 1. A heat exchanger 41 is inverted with respect to the heat exchanger shown in FIG. 1. Likewise, the direction of flow of the cooling medium is also inverted. Namely, tube 21 constitutes an inlet tube for the cooling medium and port 25 constitutes an outlet port for the cooling medium in this embodiment. Thus, block 22 may have outlet port 25.

Figure 7:
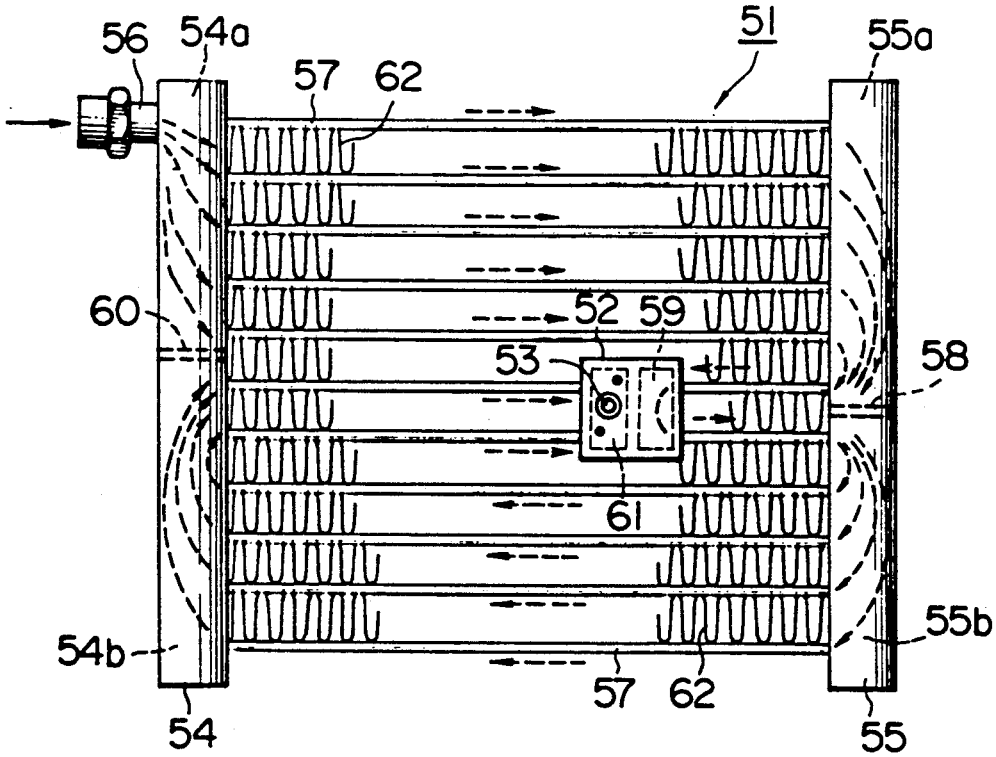
FIG. 7 is an elevational view of a heat exchanger according to a second embodiment of the present invention.

FIG. 7 illustrates a heat exchanger 51 according to a second embodiment of the present invention wherein block 52 has outlet port 53 for the cooling medium. The cooling medium is introduced into inside space 54*a* of header pipe 54 through inlet tube 56 and flows into the first to the fifth heat-transfer tubes 57. The cooling medium then flows into inside space 55*a* of header pipe 55 and turns in the inside space 55*a* by partition 58. The cooling medium flows into chamber 59 through the right portion of the sixth heat-transfer tube 57, turns therein, and then flows into the right portion of the seventh heat-transfer tube 57. The cooling medium flows into inside space 55*b* of header pipe 55, turns therein, and then flows into the eighth to the eleventh heat-transfer tubes 57. The cooling medium flows into inside space 54*b* of header pipe 54, turns therein by partition 60, and then flows into the left portions of the sixth and the seventh heat-transfer tubes 57. The cooling medium flows into chamber 61 and then out therefrom through outlet port 53. During this passage, radiation fins 62 accelerate the condensation of the cooling medium.

Figure 8:
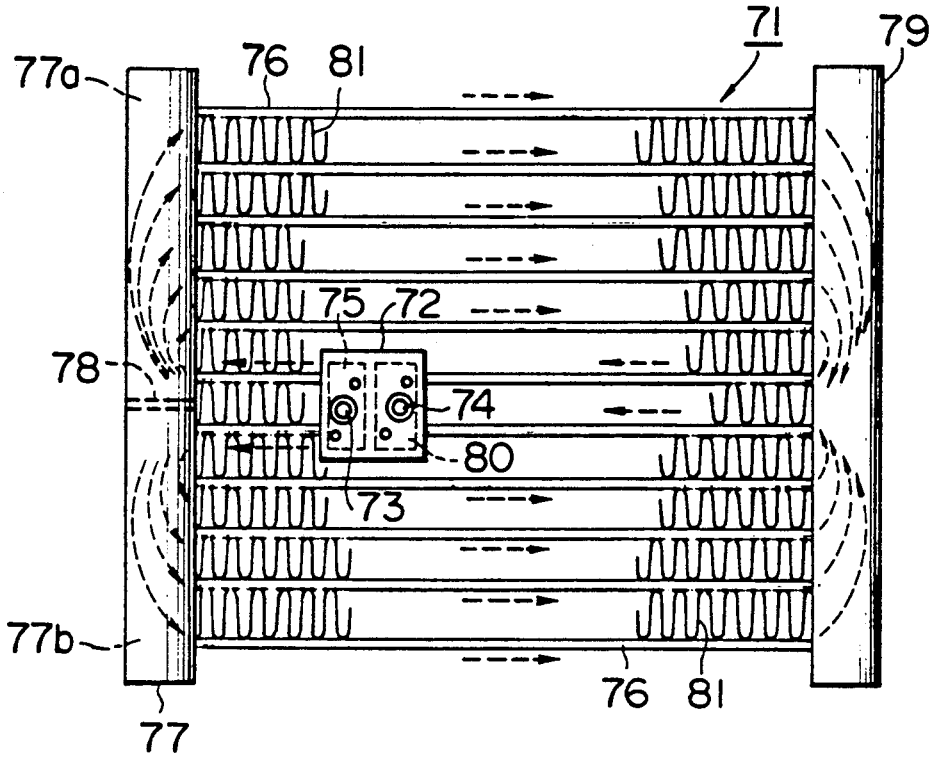
FIG. 8 is an elevational view of a heat exchanger according to a third embodiment of the present invention.

FIG. 8 illustrates a heat exchanger 71 according to a third embodiment of the present invention. In this embodiment, a block 72 has both an inlet port 73 and an outlet port 74 for the cooling medium. Therefore, typical inlet and outlet tubes are not provided in this embodiment.

The cooling medium is introduced into chamber 75 defined in block 72 through inlet port 73. The cooling medium flows from chamber 75 into the left portions of the sixth and the seventh heat-transfer tubes 76. The cooling medium from the sixth heat-transfer tube 76 flows into upper inside space 77*a* of header pipe 77 defined by partition 78 and the cooling medium from the seventh heat-transfer tube 76 flows into lower inside space 77*b* of the header pipe. The cooling medium turns in the respective inside spaces 77*a* and 77*b* and flows into the first to the fifth heat-transfer tubes 76 and the eighth to the eleventh heat-transfer tubes, respectively. Then, the cooling medium flows into the inside space of header pipe 79 and flows therefrom into the right portions of the sixth and the seventh heat-transfer tubes 76. The cooling medium flows into chamber 80 of block 72 and flows out therefrom through outlet port 74. During this passage, radiation fins 81 accelerate the condensation of the cooling medium. Although no partition is provided in header pipe 79 in this embodiment, a partition 82 may be provided at a position between the sixth and the seventh heat-transfer tubes 76 in the header pipe in order to prevent the interference of the upper flow and the lower flow of the cooling medium in the header pipe, as shown in FIG. 9.

Figure 9:
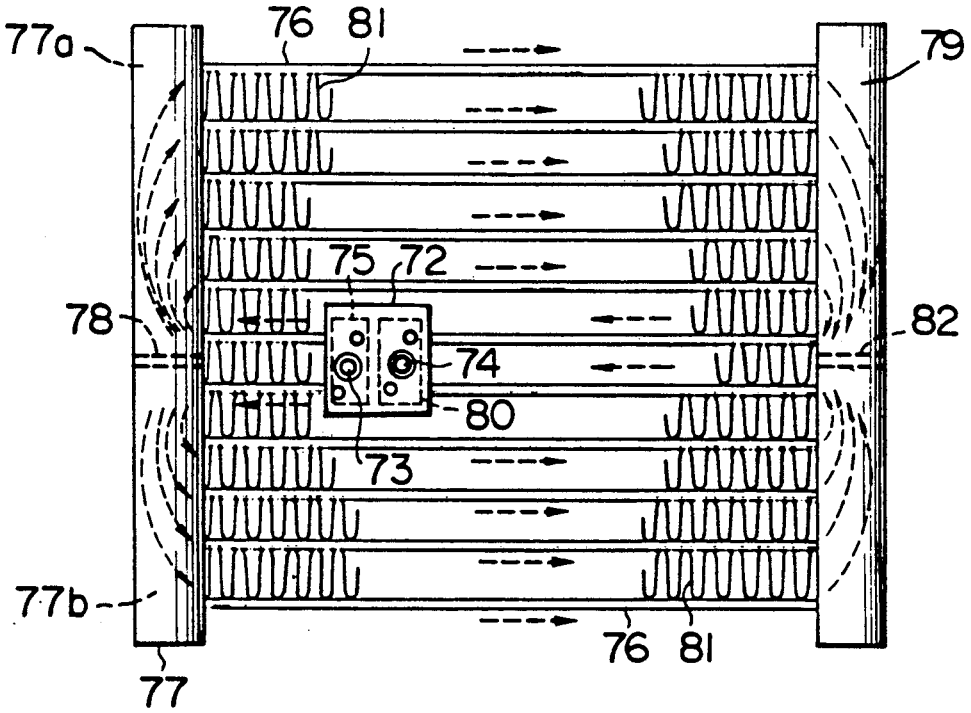
FIG. 9 is an elevational view of a heat exchanger according to a modification of the heat exchanger shown in FIG. 8.

In the embodiments shown in FIGS. 8 and 9, inlet port 73 and outlet port 74 are both provided on block 72, so that both of the ports can be located at a desired medial position between header pipes 77 and 79 when the block is positioned on the heat-transfer tubes 76 between the header pipes. This construction facilitates easy connection of the requisite pipes or tubes to both inlet port 73 and outlet port 74.

Figure 10:
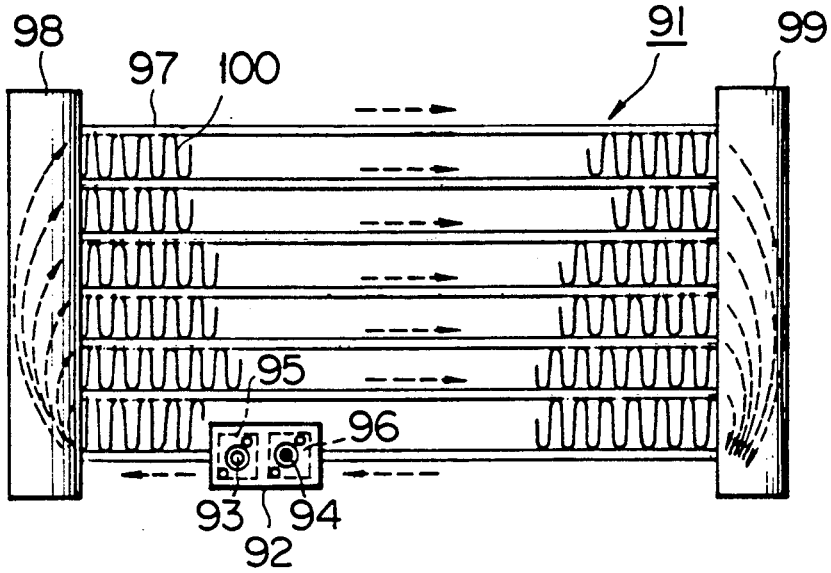
FIG. 10 is an elevational view of a heat exchanger according to a fourth embodiment of the present invention.

FIG. 10 illustrates a heat exchanger 91 according to a fourth embodiment of the present invention. In this embodiment, block 92 has inlet port 93, outlet port 94, and chambers 95 and 96. Chambers 95 and 96 communicate, respectively, with the left portion and the right portion of a single heat-transfer tube 97. The cooling medium introduced into chamber 95 through inlet port 93 flows into the left portion of the bottom heat-transfer tube 97, flows into the inside space of header pipe 98, turns therein, and then flows into a plurality of the upper heat-transfer tubes 97. The cooling medium flows from the heat-transfer tubes 97 into the inside space of header pipe 99, turns therein, and then flows into the right portion of the bottom heat-transfer tube 97. Then, the cooling medium flows into chamber 96 and out therefrom through outlet port 94. Radiation fins 100 accelerate the condensation of the cooling medium during this passage. Thus, a block according to the present invention may be connected to either a single or a plurality of heat-transfer tubes.

Figure 11:
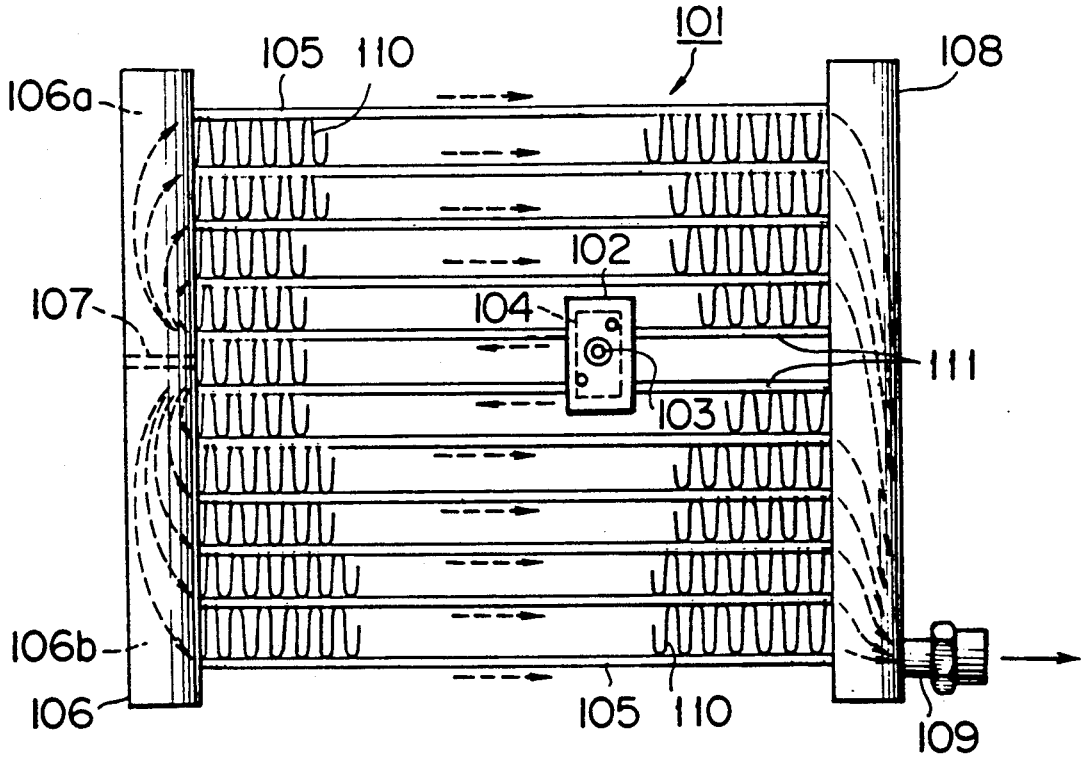
FIG. 11 is an elevational view of a heat exchanger according to a fifth embodiment of the present invention.
Figure 12:
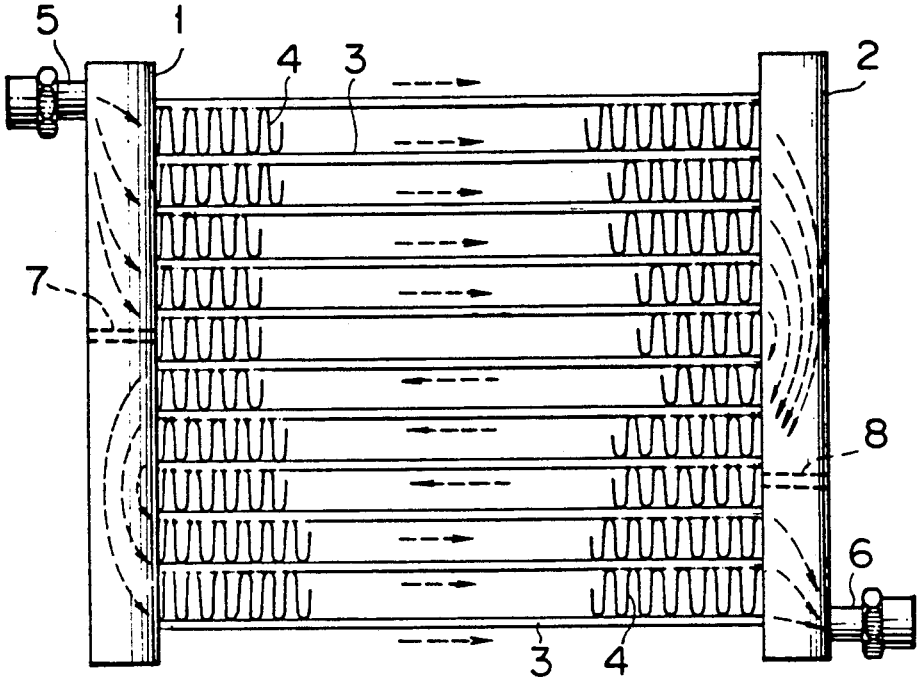
FIG. 12 PRIOR ART
FIG. 12 is an elevational view of a conventional heat exchanger.
Figure 13:
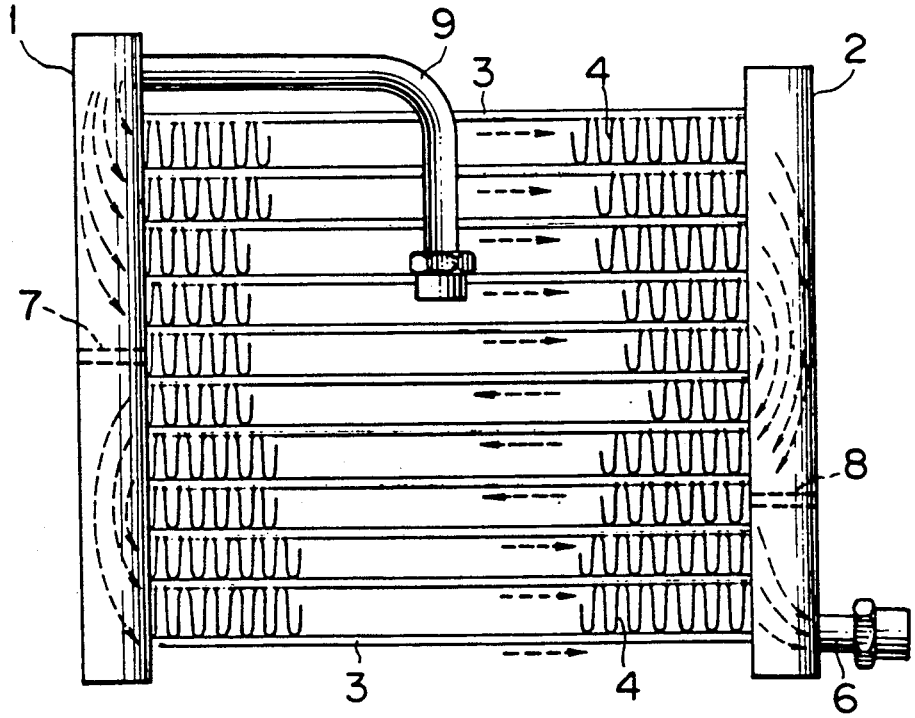
FIG. 13 PRIOR ART
FIG. 13 is an elevational view of a conventional heat exchanger according to a modification of the heat exchanger shown in FIG. 12.

FIG. 11 illustrates a heat exchanger 101 according to a fifth embodiment of the present invention. In this embodiment, block 102 has only an inlet port 103 thereon and a single chamber 104 therein. The cooling medium is introduced into chamber 104 through inlet port 103 and flows into the fifth and the sixth heat-transfer tubes 105. The cooling medium from the fifth heat-transfer tube 105 flows into inside space 106*a* of header pipe 106 defined by partition 107; and the cooling medium from the sixth heat-transfer tube flows into inside space 106*b* of the header pipe. The cooling medium from inside space 106*a* flows into the first to the fourth heat-transfer tubes 105, and then into the inside space of header pipe 108 and the cooling medium from inside space 106*b* flows into the seventh to the eleventh heat-transfer tubes 105, and then into the inside space of the header pipe 108. The cooling medium introduced into the inside space of header pipe 108 flows out from outlet tube 109 connected to the header pipe. During this passage, radiation fins 110 accelerate the condensation of the cooling medium.

In this embodiment, tubes or bars 111 connected to the right side of block 102 do not function as heat-transfer tubes in which the cooling medium flows, and only function as supports of the block. Thus, a block may have only an inlet port or an outlet port and only a single chamber communicating therewith.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

What is claimed is:

1. A heat exchanger comprising:

a pair of substantially parallel header pipes;

a plurality of substantially parallel heat-transfer tubes disposed between said header pipes, each said heat-transfer tube being connected to each of said header pipes; and a block provided at a position between said header pipes and connected to at least one of said heat-transfer tubes, said block having at least one chamber therein communicating with said at least one heat-transfer tube and at least one of an inlet port and an outlet port for a heat exchange medium therein communicating with said at least one chamber.

2. The heat exchanger according to claim 1 further comprising a plurality of radiation fins attached to said heat-transfer tubes.

3. The heat exchanger according to claim 1, wherein said heat-transfer tubes are formed as flat tubes.

4. The heat exchanger according to claim 1, wherein said block has two chambers separated from each other and said inlet port communicates with one of said two chambers

5. The heat exchanger according to claim 1, wherein said block has two chambers separated from each other and said outlet port communicates with one of said two chambers.

6. The heat exchanger according to claim 1, wherein said block has two chambers separated from each other, an inlet port and an outlet port, wherein said inlet port communicates with one of said two chambers and said outlet port communicates with the other of said two chambers.

7. The heat exchanger according to claim 1, wherein said block has two chambers separated from each other, at least one of said heat-transfer tubes is connected to one side of said block and in communication with one of said two chambers, and at least one of said heat-transfer tubes is connected to the opposite side of said block and in communication with the other of said two chambers.

8. The heat exchanger according to claim 1, wherein said block has only one chamber.

9. The heat exchanger according to claim 1, wherein an inlet tube for said heat exchange medium is connected to one of said header pipes, said block has two chambers separated from each other, said outlet port communicates with one of said two chambers, and at least two of said heat-transfer tubes communicates with the other of said two chambers.

10. The heat exchanger according to claim 1, wherein an outlet tube for said heat exchange medium is connected to one of said header pipes, said block has two chambers separated from each other, said inlet port communicates with one of said two chambers, and at least two of said heat-transfer tubes communicates with the other of said two chambers.

11. A heat exchanger comprising:

a pair of tubular generally parallel header pipes having closed ends;

a plurality of generally parallel heat-transfer tubes disposed between said header pipes, each said heat-transfer tube being in fluid communication with said header pipes; and a block positioned between said header pipes, said block comprising two hollow chambers separated by a wall, at least one heat-transfer tube being connected to one chamber and at least one other heat-transfer tube being connected to the other chamber, one of said block chambers including an inlet port and the other of said block chambers including an outlet port.

12. A heat exchanger comprising:

a pair of generally parallel tubular header pipes having closed ends;

a plurality of heat-transfer tubes extending between said header pipes and in fluid communication therewith; and a hollow block positioned between said header pipes and fluidly coupled with at least two of said heat-transfer tubes.

13. The heat exchanger as set forth in claim 12 wherein said block is formed with an inlet or outlet port.

14. The heat exchanger as set forth in claim 13 wherein a wall separates the hollow block into two chambers with one of said chambers being formed with said inlet or outlet port.

15. The heat exchanger as set forth in claim 14 wherein the other said chamber is also formed with a complementary inlet or outlet port.

* * * * *